US011060706B1

(12) United States Patent
Rivera et al.

(10) Patent No.: US 11,060,706 B1
(45) Date of Patent: Jul. 13, 2021

(54) MAGNETIC MOUNT STRING LIGHT APPARATUS

(71) Applicants: Cesar Rivera, Hialeah, FL (US); Avilio Rodriguez, Jr., Hialeah, FL (US)

(72) Inventors: Cesar Rivera, Hialeah, FL (US); Avilio Rodriguez, Jr., Hialeah, FL (US)

( * ) Notice: Subject to any disclaimer, the term of this patent is extended or adjusted under 35 U.S.C. 154(b) by 0 days.

(21) Appl. No.: 16/986,750

(22) Filed: Aug. 6, 2020

(51) Int. Cl.

| | |
|---|---|
| ***F21S 4/10*** | (2016.01) |
| ***F21V 21/096*** | (2006.01) |
| ***F21V 21/088*** | (2006.01) |
| ***F21V 23/06*** | (2006.01) |

(52) U.S. Cl.
CPC ..... *F21V 21/096* (2013.01); *F21S 4/10* (2016.01); *F21V 21/088* (2013.01); *F21V 23/06* (2013.01)

(58) Field of Classification Search
CPC ..... F21V 17/105; F21V 21/08; F21V 21/096; F21S 4/10
USPC ..... 362/249.06, 249.14, 654
See application file for complete search history.

(56) References Cited

U.S. PATENT DOCUMENTS

| | | | | |
|---|---|---|---|---|
| 5,803,577 | A | 9/1998 | Stratton | |
| 6,520,661 | B1 | 2/2003 | Hill | |
| 7,914,185 | B2 | 3/2011 | Moore | |
| 8,128,264 | B2 | 3/2012 | Genenbacher | |
| 8,308,323 | B2 | 11/2012 | Holland | |
| 8,491,168 | B2 | 7/2013 | Cooper | |
| 10,344,956 | B2 | 7/2019 | Hess | |
| 2007/0223221 | A1 | 9/2007 | George | |
| 2009/0185370 | A1 | 7/2009 | Moore | |
| 2011/0038159 | A1 | 2/2011 | Carlson | |
| 2019/0072246 | A1* | 3/2019 | Plavnicky | F21V 3/062 |
| 2019/0341718 | A1* | 11/2019 | Yu | F21V 23/06 |

* cited by examiner

*Primary Examiner* — Sean P Gramling

(57) ABSTRACT

A magnetic mount string light apparatus for easily mounting and dismounting decorative lights includes a male plug to engage a standard outlet. A female plug receives the male plug of an additional magnetic mount string light apparatus. A pair of electrical wires is coupled to the male plug and the female plug. Each electrical wire extends from the male plug to the female plug. A plurality of lights is coupled to the pair of electrical wires. A magnetic wire is coupled to the male plug and the female plug. The magnetic wire extends from the male plug to the female plug and selectively engages a ferrous surface on a building.

4 Claims, 4 Drawing Sheets

MAGNETIC MOUNT STRING LIGHT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to string light devices and more particularly pertains to a new string light device for easily mounting and dismounting decorative lights.

(2) Description of Related Art Including Information Disclosed Under 37 CFR 1.97 and 1.98

The prior art relates to string light devices. Existing devices have various forms of clips and magnetic attachments for installation. Known devices lack a magnetic wire extending along the entirety of the string light to adhere to metal surfaces as well as adhesive tabs for non-magnetic surfaces which then engage the magnetic wire.

BRIEF SUMMARY OF THE INVENTION

An embodiment of the disclosure meets the needs presented above by generally comprising a male plug configured to engage a standard outlet. A female plug receives the male plug of an additional magnetic mount string light apparatus. A pair of electrical wires is coupled to the male plug and the female plug. Each electrical wire extends from the male plug to the female plug. A plurality of lights is coupled to the pair of electrical wires. A magnetic wire is coupled to the male plug and the female plug. The magnetic wire extends from the male plug to the female plug and is configured to selectively engage a ferrous surface on a building.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
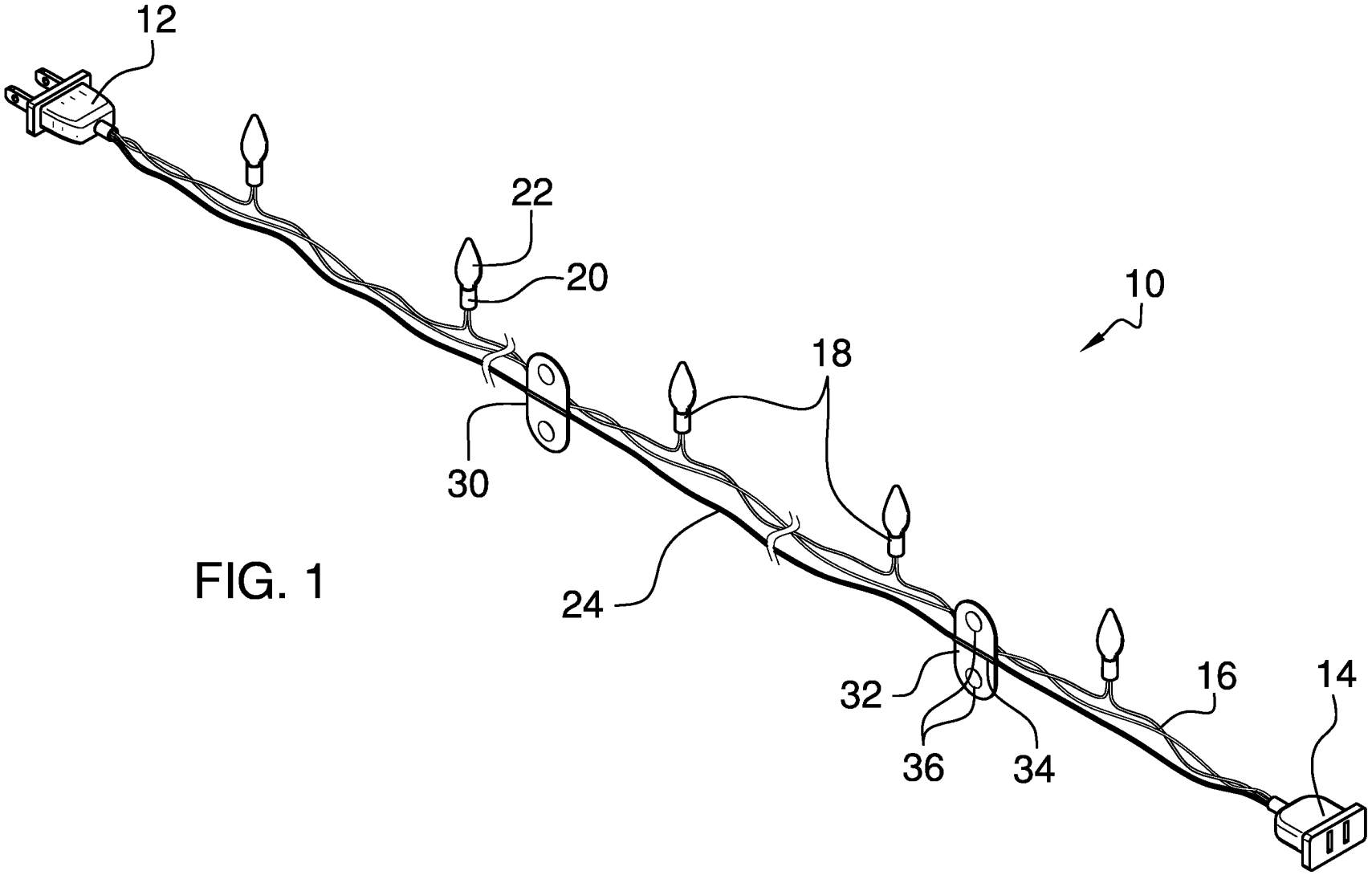
FIG. 1 is an isometric view of a magnetic mount string light apparatus according to an embodiment of the disclosure.
Figure 2:
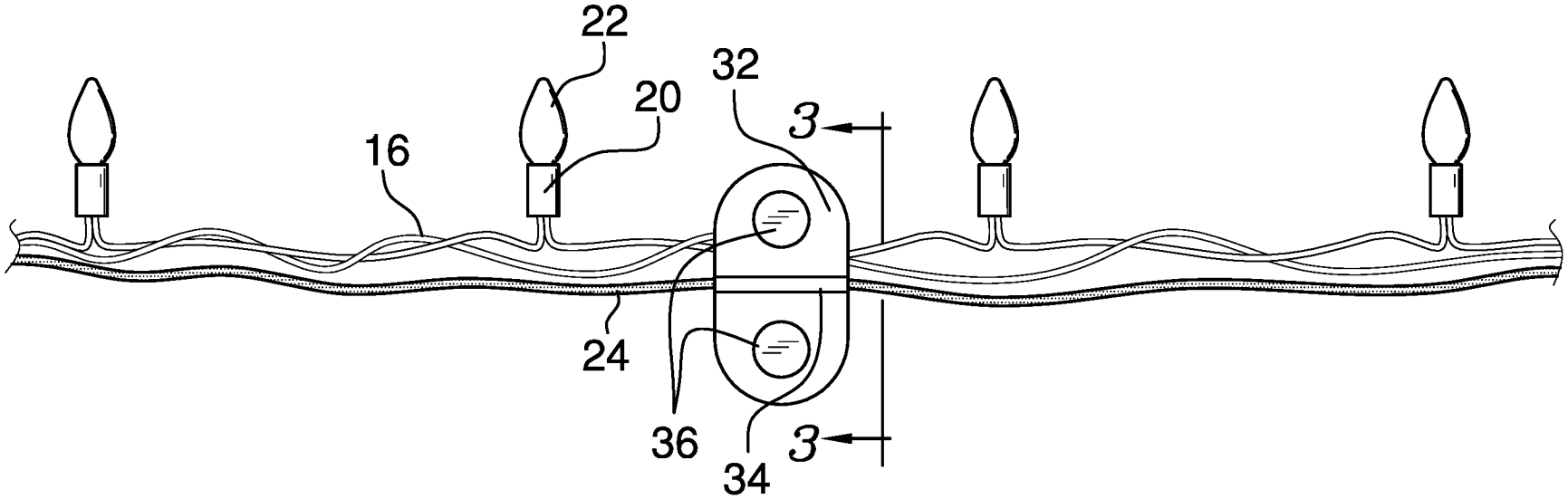
FIG. 2 is a side elevation view of an embodiment of the disclosure.

With reference now to the drawings, and in particular to FIGS. 1 through 4 thereof, a new string light device embodying the principles and concepts of an embodiment of the disclosure and generally designated by the reference numeral 10 will be described.

As best illustrated in FIGS. 1 through 4, the magnetic mount string light apparatus 10 generally comprises a male plug 12 configured to engage a standard outlet. A female plug 14 receives the male plug 12 of an additional magnetic mount string light apparatus 10. A pair of electrical wires 16 is coupled to the male plug 12 and the female plug 14. Each electrical wire 16 extends from the male plug 12 to the female plug 14 and may be intertwisted.

A plurality of lights 18 is coupled to the pair of electrical wires 16. Each light 18 has a light housing 20 coupled to, and in operational communication with, the pair of electrical wires 16 and a lightbulb 22 engaged with the light housing 20. Each lightbulb 22 may be a different and interchangeable color bulb to represent any holiday or design aesthetic of choice.

A magnetic wire 24 is coupled to the male plug 12 and the female plug 14. The magnetic wire 24 extends from the male plug 12 to the female plug 14 and is configured to selectively engage a ferrous surface 26 on a building 28.

Figure 3:
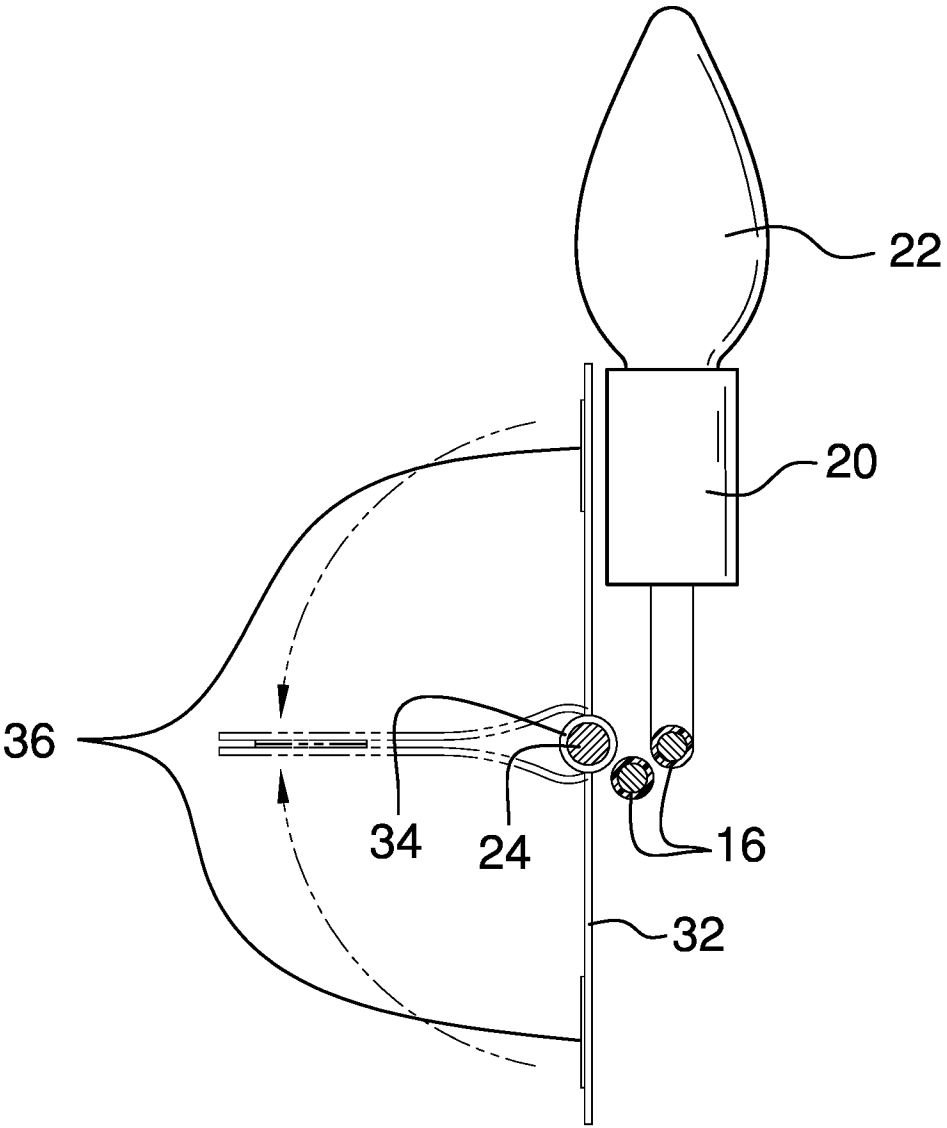
FIG. 3 is a cross-sectional view of an embodiment of the disclosure along the line 3-3 of FIG. 2.
Figure 4:
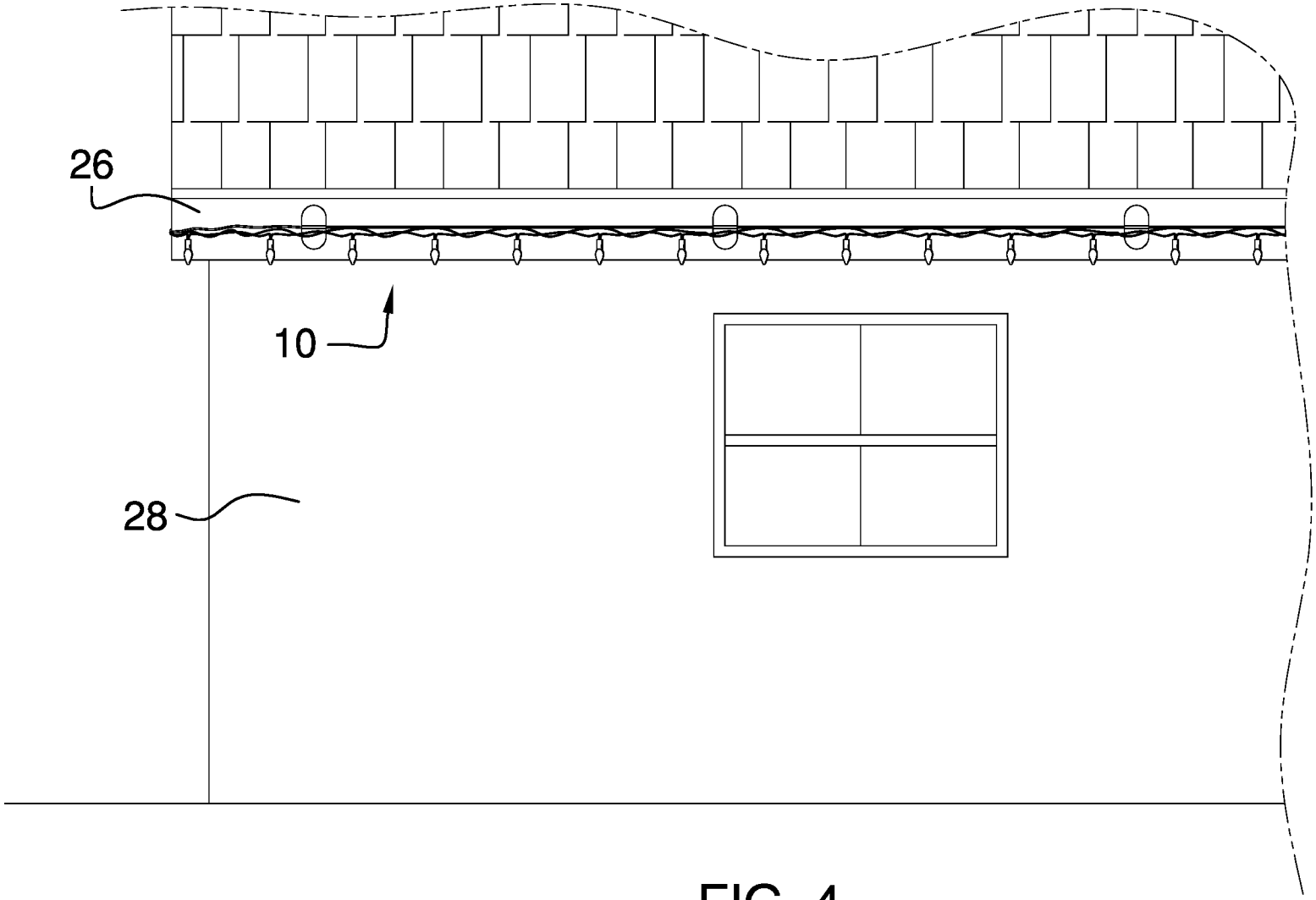
FIG. 4 is an in-use view of an embodiment of the disclosure.

A plurality of attachment tabs 30 is engageable with the magnetic wire 32. Each attachment tab 30 may have a tab backing 32 and a sleeve 34 coupled to the tab backing 32 and around the magnetic wire 24, and a pair of magnets 36 coupled to the tab backing 32. The tab backing 32 may be obround with the sleeve 34 being positioned across a midline thereof. The pair of magnets 36 is positioned on each side of the sleeve 34 and the tab backing 32 is substantially flexible for the pair of magnets 36 to selectively engage each other as shown in FIG. 3. Each attachment tab 30 is configured to selectively engage a ferrous or non-ferrous surface of the building 28. The tab backing 32 may have an adhesive surface or may receive mounting hardware to mount to a non-ferrous surface of the building 28.

In use, the magnetic wire 24 is used to attach the apparatus 10 to the building 28 when possible and the male plug 12 is engaged with a power outlet. For added reinforcement or when there is no ferrous surface available, the plurality of attachment tabs 30 are engaged with the building 28 to support the magnetic wire 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A magnetic mount string light apparatus comprising:

a male plug, the male plug being configured to engage a standard outlet;

a female plug, the female plug receiving the male plug of an additional magnetic mount string light apparatus;

a pair of electrical wires coupled to the male plug and the female plug, each electrical wire extending from the male plug to the female plug;

a plurality of lights coupled to the pair of electrical wires;

a magnetic wire coupled to the male plug and the female plug, the magnetic wire extending from the male plug to the female plug and being configured to selectively engage a ferrous surface on a building; and a plurality of attachment tabs engageable with the magnetic wire, each attachment tab being configured to selectively engage a ferrous or non-ferrous surface of the building, each attachment tab having a tab backing, a sleeve coupled to the tab backing, the sleeve being coupled around the magnetic wire, and a pair of magnets coupled to the tab backing, the tab backing being obround with the sleeve being positioned across a midline thereof, the pair of magnets being positioned on each side of the sleeve and the tab backing being substantially flexible for the pair of magnets to selectively engage each other.

2. The magnetic mount string light apparatus of claim 1 further comprising each tab having at least one magnet, the magnets being selectively engageable with the magnetic wire.

3. The magnetic mount string light apparatus of claim 1 further comprising each light having a light housing coupled to the pair of electrical wires and a lightbulb engaged with the light housing.

4. A magnetic mount string light apparatus comprising:

a male plug, the male plug being configured to engage a standard outlet;

a female plug, the female plug receiving the male plug of an additional magnetic mount string light apparatus;

a pair of electrical wires coupled to the male plug and the female plug, each electrical wire extending from the male plug to the female plug;

a plurality of lights coupled to the pair of electrical wires, each light having a light housing coupled to the pair of electrical wires and a lightbulb engaged with the light housing;

a magnetic wire coupled to the male plug and the female plug, the magnetic wire extending from the male plug to the female plug and being configured to selectively engage a ferrous surface on a building; and a plurality of attachment tabs engageable with the magnetic wire, each attachment tab having a tab backing, a sleeve coupled to the tab backing, the sleeve being coupled around the magnetic wire, and a pair of magnets coupled to the tab backing, the tab backing being obround with the sleeve being positioned across a midline thereof, the pair of magnets being positioned on each side of the sleeve and the tab backing being substantially flexible for the pair of magnets to selectively engage each other, each attachment tab being configured to selectively engage a ferrous or non-ferrous surface of the building.

* * * * *